US006408143B2

(12) United States Patent
Sakurai et al.

(10) Patent No.: US 6,408,143 B2
(45) Date of Patent: Jun. 18, 2002

(54) ELECTROPHOTOGRAPHIC IMAGE FORMING APPARATUS

(75) Inventors: Kazushige Sakurai; Kazushi Watanabe, both of Mishima; Toshiyuki Karakama, Shizuoka-ken; Hideki Matsumoto, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,929

(22) Filed: Dec. 29, 2000

(30) Foreign Application Priority Data

Jan. 7, 2000 (JP) ..... 2000-001380
Dec. 12, 2000 (JP) ..... 2000-377741

(51) Int. Cl.[7] ..... G03G 15/08
(52) U.S. Cl. ..... 399/27; 399/81
(58) Field of Search ..... 399/27, 24, 25, 399/29, 81

(56) References Cited

U.S. PATENT DOCUMENTS

| | | | | |
|---|---|---|---|---|
| 5,095,335 | A | 3/1992 | Watanabe et al. | 399/111 |
| 5,151,734 | A | 9/1992 | Tsuda et al. | 399/111 |
| 5,208,634 | A | 5/1993 | Ikemoto et al. | 399/111 |
| 5,223,893 | A | 6/1993 | Ikemoto et al. | 399/111 |
| 5,294,960 | A | 3/1994 | Nomura et al. | 399/113 |
| 5,331,372 | A | 7/1994 | Tsuda et al. | 399/114 |
| 5,345,294 | A | 9/1994 | Nomura et al. | 399/90 |
| 5,404,198 | A | 4/1995 | Noda et al. | 399/107 |
| 5,455,665 | A | 10/1995 | Baba et al. | 399/358 |
| 5,463,446 | A | 10/1995 | Watanabe et al. | 399/111 |
| 5,465,136 | A | 11/1995 | Watanabe | 399/111 |
| 5,470,635 | A | 11/1995 | Shirai et al. | 428/131 |
| 5,475,470 | A | 12/1995 | Sasago et al. | 399/111 |
| 5,475,471 | A | 12/1995 | Kisu et al. | 399/115 |
| 5,488,459 | A | 1/1996 | Tsuda et al. | 399/167 |
| 5,500,714 | A | 3/1996 | Yashiro et al. | 399/111 |
| 5,510,878 | A | 4/1996 | Noda et al. | 399/111 |
| 5,534,344 | A | 7/1996 | Kisu et al. | 428/323 |
| 5,541,711 | A | 7/1996 | Kisu et al. | 399/176 |
| 5,543,898 | A | 8/1996 | Shishido et al. | 399/111 |
| 5,561,504 | A | 10/1996 | Watanabe et al. | 399/111 |
| 5,583,613 | A | 12/1996 | Kobayashi et al. | 399/111 |
| 5,585,895 | A | 12/1996 | Yashiro et al. | 399/103 |
| 5,602,623 | A | 2/1997 | Nishibata et al. | 399/111 |
| 5,608,509 | A | 3/1997 | Shirai et al. | 399/351 |
| 5,617,579 | A | 4/1997 | Yashiro et al. | 399/114 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |

(List continued on next page.)

FOREIGN PATENT DOCUMENTS

| | | | |
|---|---|---|---|
| JP | 01-209466 A | * | 8/1989 |
| JP | 10-047948 A | * | 2/1998 |

*Primary Examiner*—Sophia S. Chen
(74) *Attorney, Agent, or Firm*—Fitzpatrick, Cella, Harper & Scinto

(57) ABSTRACT

An electrophotographic image forming apparatus for forming an image on a recording medium includes an electrophotographic photosensitive member, an electrostatic latent image forming device for forming an electrostatic latent image on the electrophotographic photosensitive member, a developing device for developing the electrostatic latent image formed on the electrophotographic photosensitive member, a developer remaining amount detecting device for successively detecting the remaining amount of developer to be used for the development of the electrostatic latent image by the developing device, and a developer remaining amount indicating device for indicating the remaining amount of developer detected by the developer remaining amount detecting device. The developer remaining amount indicating device indicates the remaining amount of developer as a gauge and indicates it with graduations shown on the gauge that are changed over in conformity with the remaining amount of developer.

11 Claims, 12 Drawing Sheets

U.S. PATENT DOCUMENTS 5,689,774 A 11/1997 Shishido et al. ..... 399/111
5,749,027 A 5/1998 Ikemoto et al. ..... 399/113
5,765,077 A 6/1998 Sakurai et al. ..... 399/176
5,768,658 A 6/1998 Watanabe et al. ..... 399/111
5,768,660 A 6/1998 Kurihara et al. ..... 399/111
5,774,766 A 6/1998 Karakama et al. ..... 399/111
5,790,923 A 8/1998 Oguma et al. ..... 399/106
5,794,101 A 8/1998 Watanabe et al. ..... 399/103
5,802,420 A * 9/1998 Garr et al. ..... 399/27
5,809,374 A 9/1998 Tsuda et al. ..... 399/111
5,812,909 A 9/1998 Oguma et al. ..... 399/103
5,828,928 A 10/1998 Sasago et al. ..... 399/111
5,878,304 A 3/1999 Watanabe et al. ..... 399/92
5,878,310 A 3/1999 Noda et al. ..... 399/117
5,884,124 A 3/1999 Karakama et al. ..... 399/123
5,890,036 A 3/1999 Karakama et al. ..... 399/119
5,899,602 A 5/1999 Noda et al. ..... 399/111
5,903,803 A 5/1999 Kawai et al. ..... 399/116
5,920,752 A 7/1999 Karakama et al. ..... 399/111
5,937,242 A 8/1999 Yokoyama et al. ..... 399/114
5,943,528 A 8/1999 Akutsu et al. ..... 399/110
5,966,566 A 10/1999 Odagawa et al. ..... 399/109
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,070,028 A 5/2000 Odagawa et al. ..... 399/104
6,075,956 A 6/2000 Watanabe et al. ..... 399/92
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,032,007 A 9/2000 Yamaji et al. ..... 399/104
6,118,960 A 9/2000 Nakagawa et al. ..... 399/111
6,128,454 A 10/2000 Kawai et al. ..... 399/116
6,144,398 A 11/2000 Yokoyama et al. ..... 347/263
6,160,976 A 12/2000 Karakama et al. ..... 399/104
6,163,665 A 12/2000 Watanabe et al. ..... 399/111
6,169,866 B1 1/2001 Watanabe et al. ..... 399/111
6,175,706 B1 1/2001 Watanabe et al. ..... 399/167
6,330,402 B1 * 12/2001 Sakurai et al. ..... 399/27 X

* cited by examiner

ELECTROPHOTOGRAPHIC IMAGE FORMING APPARATUS

BACKGROUND OF THE INVENTION

1. Field of the Invention

This invention relates to an electrophotographic image forming apparatus for forming an image on a recording medium by the use of the electrophotographic method, such as a printer, a copier or a facsimile apparatus.

2. Related Background Art

In an electrophotographic image forming apparatus using the electrophotographic image forming process, there has heretofore been adopted a process cartridge system in which an electrophotographic photosensitive member and process means for acting on this electrophotographic photosensitive member are integrally made into a cartridge, which is made detachably mountable on the main body of the image forming apparatus. According to this process cartridge system, the maintenance of the apparatus can be done by a user himself without resorting to a serviceman and therefore, operability could be markedly improved. So, this process cartridge system is widely used in electrophotographic image forming apparatuses.

Among image forming apparatuses of such a cartridge interchange type, there is one having the function of detecting that the toner remaining amount in the cartridge has become equal to or less than a predetermined value, and informing the user of it, as the standard when the user effects the interchange of the cartridge.

There has also been put into practical use one having the function of successively detecting the remaining amount of toner, indicating the remaining amount of toner by a gauge corresponding to the amount of toner as shown in FIG. 12 of the accompanying drawings and informing the user of it, for an improvement in usability.

In a toner remaining amount indicating device 140 as developer remaining amount indicating means shown in FIG. 12, the users is informed of the toner remaining amount by which portion of a gauge 142 a pointer 141 movable in conformity with the toner remaining amount is pointing to.

In this indicating device 140, all toner amounts from "Full" to "Empty" shown in FIG. 12 are indicated by a single gauge 142.

SUMMARY OF THE INVENTION

The present invention is a further development of the aforedescribed art.

It is an object of the present invention to provide an electrophotographic image forming apparatus which can indicate the remaining amount of developer.

It is another object of the present invention to provide an electrophotographic image forming apparatus which can obviously indicate the remaining amount of developer.

It is still another object of the present invention to provide an electrophotographic image forming apparatus which, when the remaining amount of developer has become smaller than a predetermined remaining amount, can indicate it by increasing the width of graduations for indicating the developer remaining amount.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

An electrophotographic image forming apparatus according to the present invention will hereinafter be described in greater detail with reference to the drawings.

Embodiment 1

Figure 1:
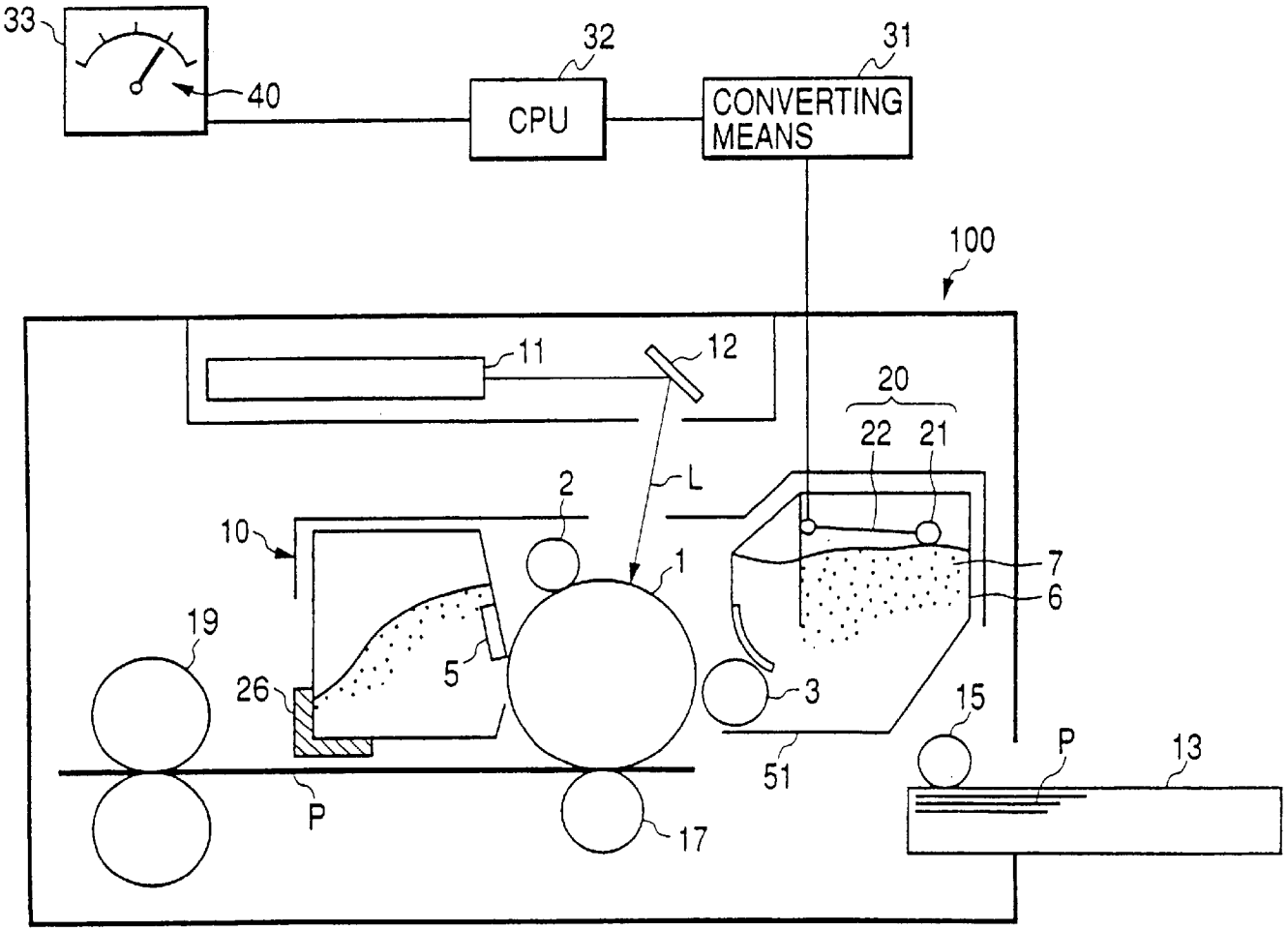
FIG. 1 schematically shows the construction of an embodiment of an electrophotographic image forming apparatus according to the present invention.

A first embodiment of the present invention will first be described with reference to FIGS. 1 to 3. FIG. 1 shows an electrophotographic image forming apparatus 100 on which a process cartridge 10 in the present embodiment is mounted.

As shown in FIG. 1, the electrophotographic image forming apparatus 100 according to the present embodiment is such that a laser beam L modulated in conformity with an image signal is outputted from a scanner unit 11 as electrostatic latent image forming means including a laser, a polygon mirror and a correction system lens. This laser beam L is reflected by a turn-back mirror 12 and is applied onto a photosensitive drum 1 which is an electrophotographic photosensitive member. The photosensitive drum 1 is uniformly charged in advance by a charging roller 2 which is a charging member, and an electrostatic latent image is formed on the surface thereof in conformity with the application of the laser beam L.

On the other hand, a toner 7 which is a developer stored in a toner hopper 6 as a developer container is carried while charging the peripheral surface of a developing sleeve 3 which is developing means, and a toner layer capable of developing is formed on the developing sleeve 3. The electrostatic latent image on the photosensitive drum 1 is developed by this toner layer and is visualized as a toner image.

On the other hand, a recording member P which is a recording medium contained in a cassette 13 is supplied in synchronism with the formation of the latent image on the photosensitive drum 1 by a feed roller 15. This recording member P is conveyed to roller-shaped transferring means 17 in synchronism with the leading end of the toner image on the photosensitive drum 1, and the toner image is transferred onto the recording member P by the transferring means 17. The recording member P to which the toner image has been transferred is conveyed to a fixing device 19, where the toner image is fixed and a permanent image is obtained. Any toner residual on the photosensitive drum 1 is removed by cleaning means 5.

In the present embodiment, the photosensitive drum 1, the charging roller 2, a developing device 51 including the developing sleeve 3, and the cleaning means 5 are integrally constructed as a process cartridge 10, which is detachably mounted on the main body of the electrophotographic image forming apparatus (hereinafter referred to as the "main body of the apparatus") through mounting means 26, whereas the process cartridge is not restricted this construction, but can be of a construction provided with at least the photosensitive drum 1 and the developing device 51.

The process cartridge (hereinafter referred to as the "cartridge") 10 is interchanged when the toner 7 stored in the toner hopper 6 has been depleted or when the life of the photosensitive drum 1 has expired.

In the present embodiment, provision is made of developer remaining amount detecting means 20 for successively detecting the amount of toner remaining in the toner hopper 6 of the cartridge 10, and provision is made of converting means 31 for converting the signal of the developer remaining amount detecting means 20 into an electrical signal in the main body of the apparatus.

As the developer remaining amount detecting means in the present invention, use can be made of any means capable of detecting the amount of toner remaining in the toner hopper, without being specially limited. Specifically, use can be made of means for detecting the position of a contacting member disposed on the surface of the upper portion of the toner, means for detecting the torque of an agitating member for agitating the toner in the toner hopper, means for optically detecting the position of the surface of the upper portion of the toner, means for detecting any change in the capacitance by the amount of toner, or the like.

The developer remaining amount detecting means 20 in the present embodiment is means for detecting the position of the contacting member 21 disposed on the surface of the upper portion of the toner by an arm 22 which is a following member.

That is, the design of the apparatus is made such that the position of the contacting member 21 detected by the arm 22 is converted into an electrical signal by the converting means 31 and is sent to a CPU 32, and a calculation is effected by the CPU 32 so that the electrical signal may become a signal conforming to the toner amount, and the signal is sent to developer remaining amount indicating means 33.

In the present embodiment, the amount of toner stored in the toner hopper 6 of the cartridge 10 was 500 g when the toner was new. Also, the number of printable sheets at the standard coverage rate in this amount of toner was 10,000 sheets.

The image forming apparatus according to the present embodiment will now be further described with reference to the block diagram of FIG. 2.

According to the present embodiment, the position of the contacting member 21 detected by the arm 22 of the developer remaining amount detecting means 20 disposed in the cartridge 10 is converted into an electrical signal by converting means 31 in a control portion 30, and is sent to a CPU 32. The CPU 32 calculates the developer remaining amount from the electrical signal, and sends a signal indicative of the developer remaining amount to developer amount indicating means 33.

Figure 2:
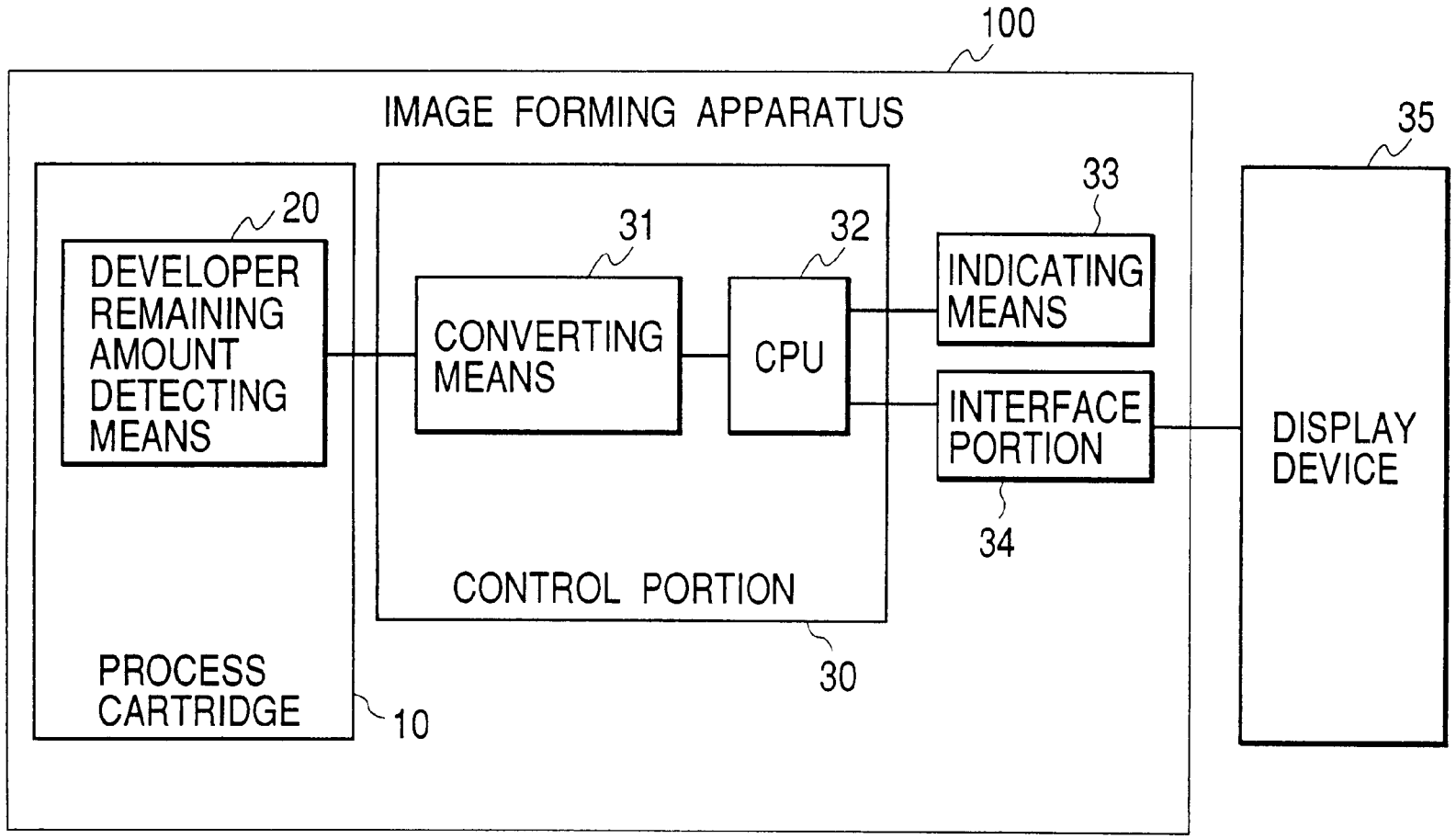
FIG. 2 is a block diagram of an embodiment of the electrophotographic image forming apparatus according to the present invention.

Also, as shown in FIG. 2, the signal of the CPU 32 may be sent to an external display device 35 through an interface portion 34 and may be displayed on the screen of the external device. As a specific example of the external device, for example, in an image forming apparatus connected to a personal computer network, mention may be made of the display screen of a host computer electrically connected to the main body of the image forming apparatus.

By doing so, the user can know the developer remaining amount while operating the host computer.

Figure 3:
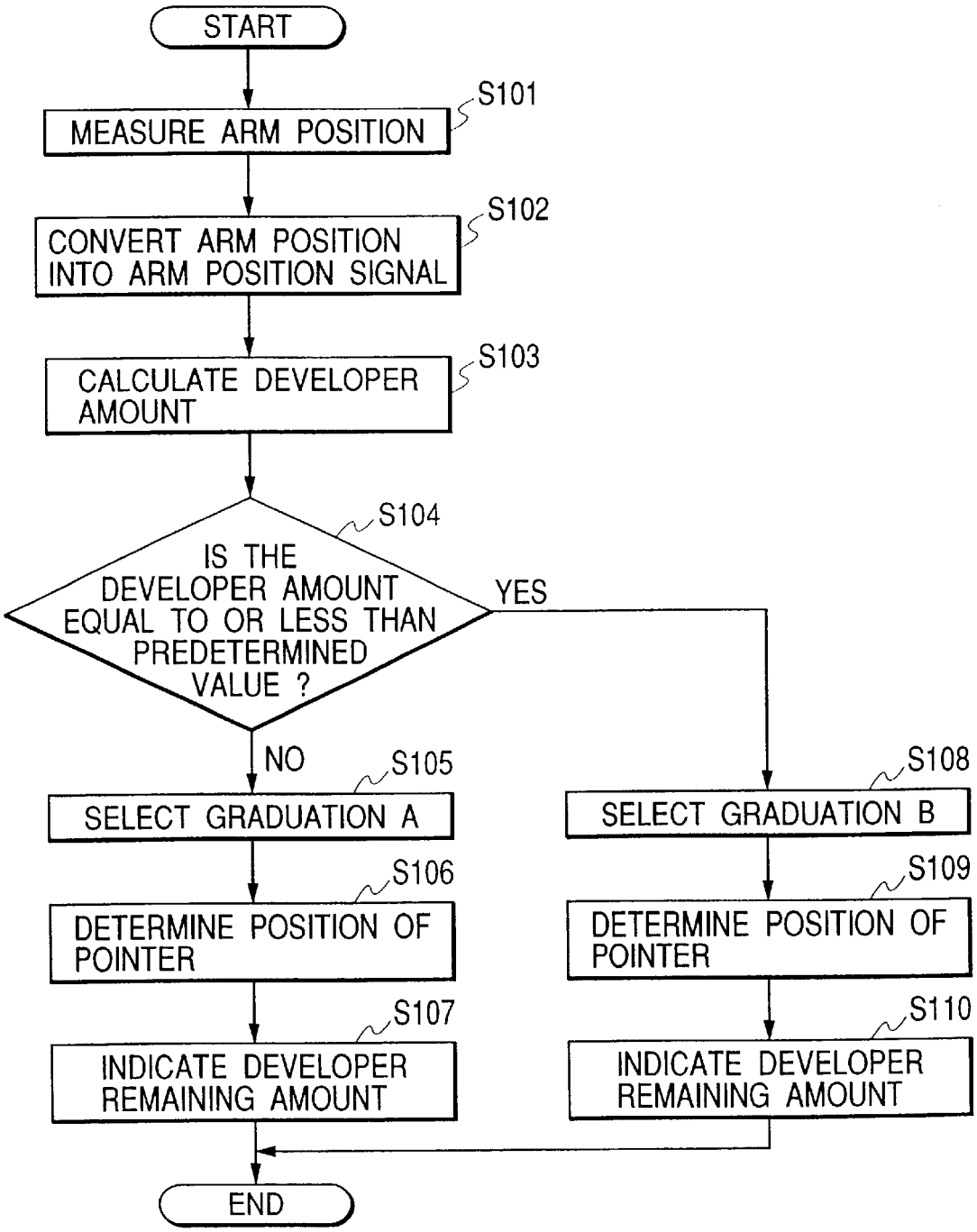
FIG. 3 is a flow chart of an embodiment of the developer remaining amount indicating operation according to the present invention.

FIG. 3 shows a flow chart of the developer remaining amount indicating operation in the present embodiment. The operation of the present embodiment will hereinafter be described with reference to FIG. 3.

The position of the arm 22 is first measured by the developer remaining amount detecting means 20 (S101). Next, the position of the arm 22 is converted into a position signal by the converting means 31 (S102). The position signal is sent to the CPU 32, by which the developer remaining amount is calculated (S103). Whether the found developer amount is greater or smaller than a predetermined value is judged (S104). If it is greater than the predetermined value, there still remains a great amount of developer and therefore, a graduation A for a great developer amount corresponding to one graduation is selected (S105), and the position of a pointer indicating the graduation is determined (S106). Thereafter, the developer remaining amount is indicated on the indicating means 33 (S107).

When the developer amount is equal to or less than the predetermined value, the exhaustion of the developer is near and therefore, a graduation B for a small developer amount corresponding to one graduation is selected (S108), and the position of the pointer indicating the graduation is determined (S109). Thereafter, the developer remaining amount is indicted on the indicating means 33 (S110).

Figure 4A:
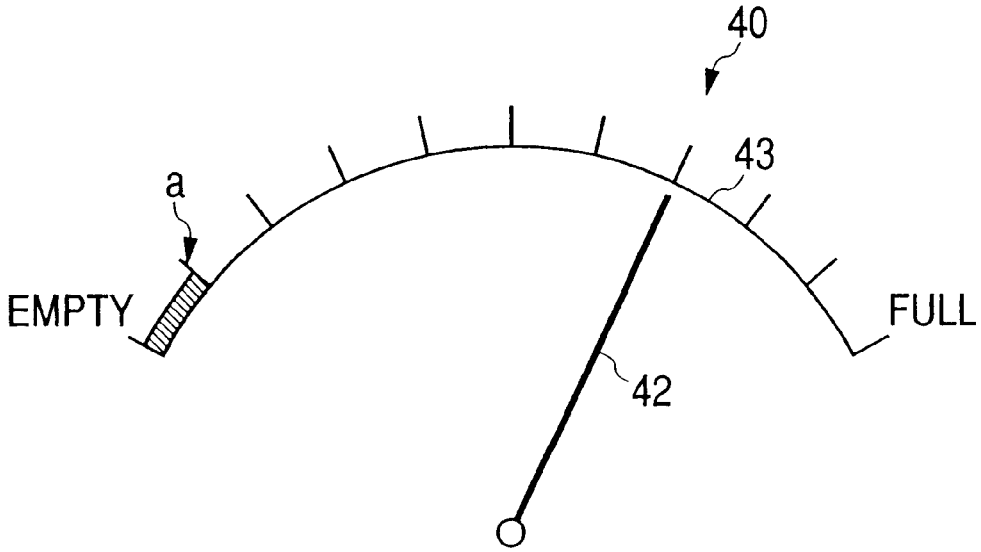
FIGS. 4A and 4B show an example of the developer amount indication according to the present invention.
Figure 4B:
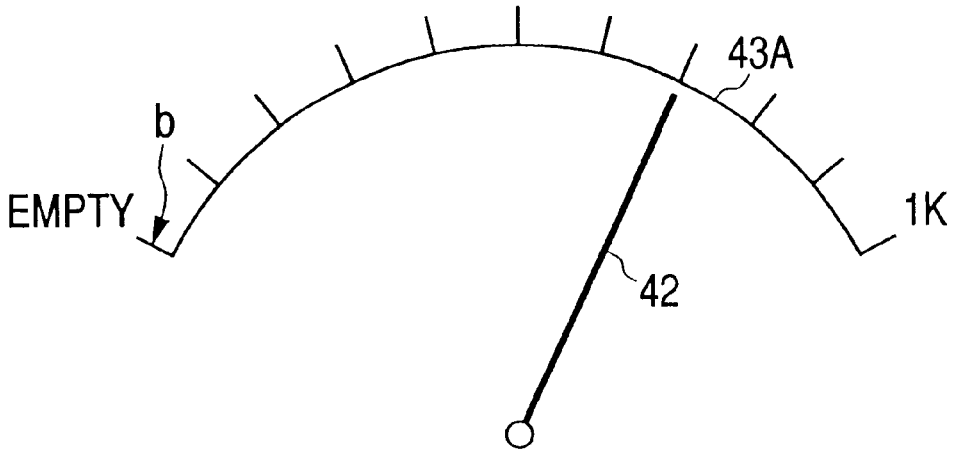

FIGS. 4A and 4B show an example of the developer remaining amount indication 40 by the developer amount indicating means 33 in the present embodiment.

A pointer 42 in FIG. 4A moves in conformity with the surface of the upper portion of the toner in the toner hopper 6. Also, a gauge 43 is equally divided between "Full" to "Empty" into ten regions, and a graduation represents 50 g. This gauge 43 corresponds to the graduation A described with reference to the flow chart of FIG. 3. 50 g is a value equal to the toner amount consumed when 1,000 sheets are printed at the standard coverage rate. The pointer 42 points to "Full" when the toner amount is 500 g, and moves in conformity with the toner remaining amount. When the pointer 42 has come to a portion "a" shown in FIG. 4A, that is, the toner remaining amount has become 50 g, the indication is changed over to a gauge 43A shown in FIG. 4B.

The gauge 43A in FIG. 4B is equally divided from "1K" to "Empty" into ten regions, and a graduation represents the toner amount consumed when 100 sheets are printed at the standard coverage rate, i.e., 5 g. This gauge 43A corresponds to the graduation B described with reference to the flow chart of FIG. 3. The pointer 42, as in FIG. 4A, moves in conformity with the toner remaining amount, but is adjusted so as to move by one graduation each time 5 g of toner is consumed. When the pointer 42 has moved to a portion "b"

shown in FIG. 4B, the toner is depleted. "1K" in FIG. 4B shows that the number of remaining printable sheets is about 1,000 sheets at the standard coverage rate.

Thus, by adopting a construction in which the indication on the gauge changes over so as to indicate the toner remaining amount in greater detail when the toner remaining amount has become equal to or less than a predetermined value, that is, in conformity with detection information detecting that the toner remaining amount has become smaller than a predetermined remaining amount, the width of the graduation for indicating the toner remaining amount is changed so as to become greater than the width of the already indicating graduation by the CPU 32 serving also as changeover means, and therefore, the toner remaining amount in a state in which the toner amount is small can be accurately and visibly communicated to the user.

In the present embodiment, the colors of the gauge 43 of FIG. 4A and the gauge 43A of FIG. 4B may be made different from each other in order that the user may easily recognize that the indication has changed over.

Also, in the gauge 43 shown in FIG. 4A, the color of the last one graduation may be made different in the sense of warning that the toner remaining amount is small.

Figure 5A:
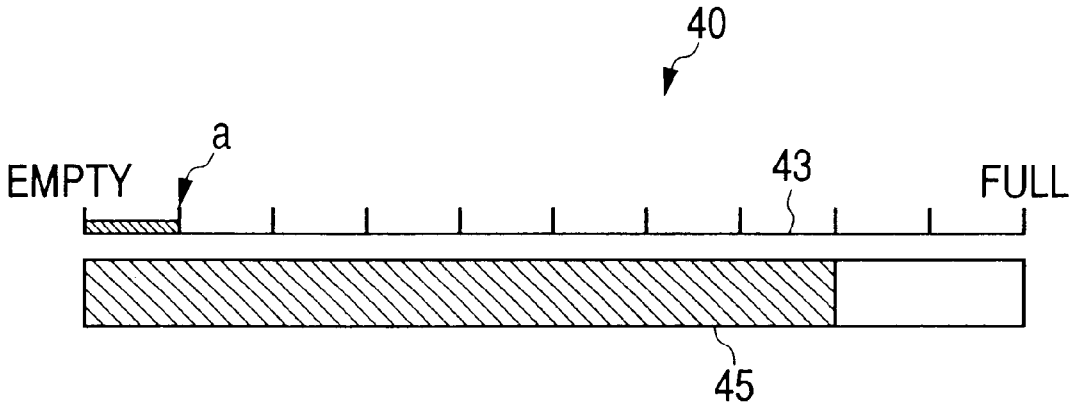
FIGS. 5A and 5B show a modification of the developer amount indication shown in FIGS. 4A and 4B.
Figure 5B:
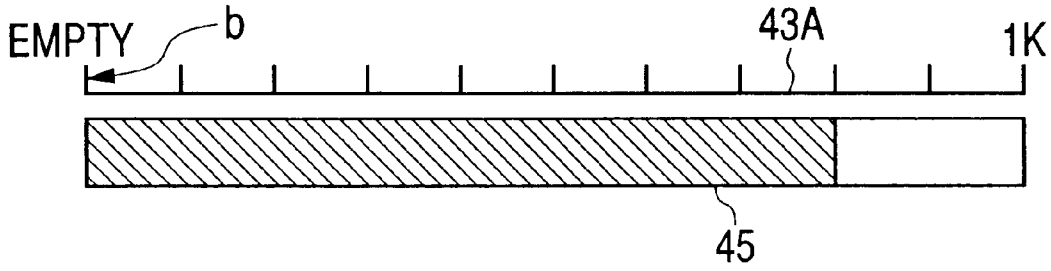

FIGS. 5A and 5B show a modification of the present embodiment in which the toner amount is indicated by a bar 45 instead of the pointer. Again in such a construction, an effect similar to that described above can be obtained.

Such indication of the toner remaining amount may be done on a display portion provided on the main body of the image forming apparatus, but in an image forming apparatus connected to a personal computer network, there may be adopted a form in which the toner remaining amount is displayed on the display screen of each host computer.

Embodiment 2

A second embodiment of the present invention will now be described with reference to FIGS. 6, 7A, 7B, 8A and 8B.

This embodiment is characterized in that when the toner remaining amount becomes equal to or less than a predetermined value, the gauge is changed over and the graduations are enlarged, whereby when the toner has been depleted, an accurate remaining amount is communicated to the user and the gauge for indicating the toner remaining amount after the changeover is made different from the gauge before the changeover to thereby make it more comprehensible to the user that the toner remaining amount is small.

The cartridge, the construction of the main body of the apparatus and the block diagram in the present embodiment are similar to those in the first embodiment and therefore need not be described.

Figure 6:
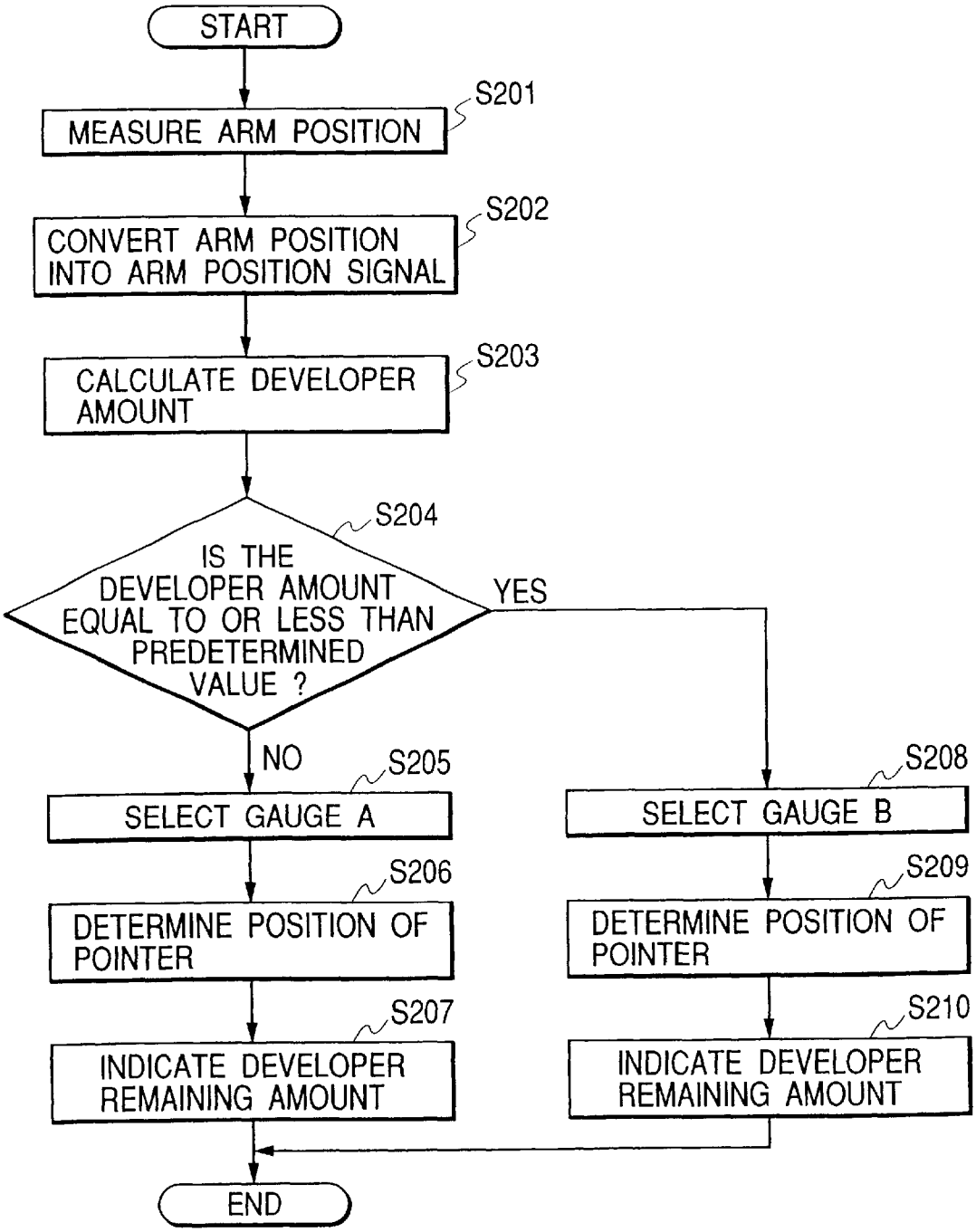
FIG. 6 is a flow chart of another embodiment of the developer remaining amount indicating operation according to the present invention.

FIG. 6 shows a flow chart of the toner remaining amount indicating operation in the present embodiment. The operation of the present embodiment will hereinafter be described with reference to FIG. 6.

First, the position of the arm 22 is detected by the developer remaining amount detecting means 20 (S201). Next, the position of the arm 22 is converted into a position signal by the converting means 31 (S202). The position signal is sent to the CPU 32, by which the developer remaining amount is calculated (S203). Whether the found developer amount is greater or smaller than a predetermined value is judged (S204). If it is greater than the predetermined value, the developer still remains in a great amount and therefore, a gauge A wide in the developer remaining amount indication range is selected (S205), and the position of the pointer is determined (S206). Thereafter, the developer remaining amount is indicated on the indicating means 33 (S207).

If the developer amount is equal to or less than the predetermined value, the exhaustion of the developer is near and therefore, a gauge B for indicating a narrow range in detail is selected (S208), and the position of the pointer is determined (S209). Thereafter, the developer remaining amount is indicated on the indicating means 33 (S210).

Figure 7A:
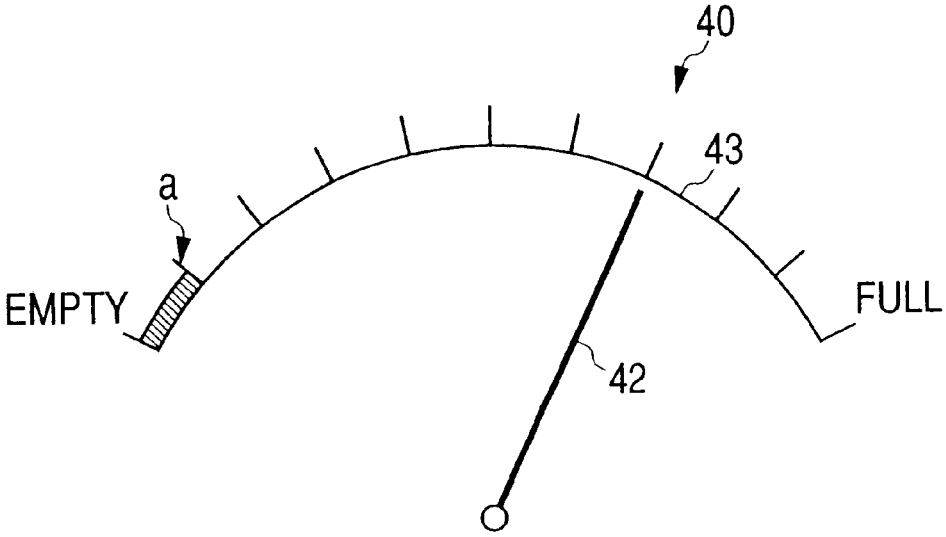
FIGS. 7A and 7B show a further example of the developer amount indication according to the present invention.
Figure 7B:
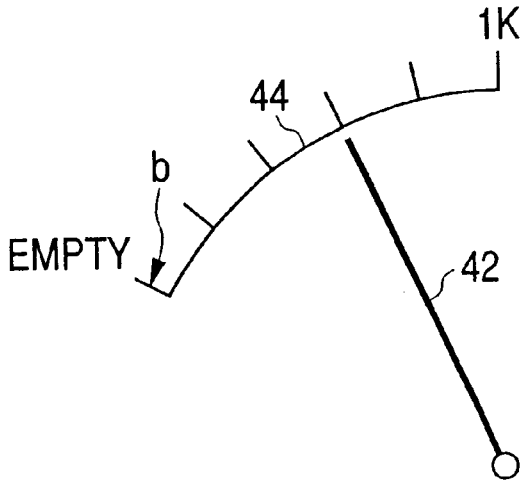

FIGS. 7A and 7B show an example of the developer remaining amount indication 40 on the developer amount indicating means 33 in the present embodiment.

The pointer 42 in FIG. 7A moves in conformity with the surface of the upper portion of the toner in the toner hopper 6. Also, a gauge 43 is equally divided from "Full" to "Empty" into ten regions, and one graduation corresponds to 50 g. 50 g is a value equal to the toner amount consumed when 1,000 sheets are printed at the standard coverage rate. This gauge 43 corresponds to the gauge A described with reference to the flow chart of FIG. 6. The pointer 42 points to the portion "Full" of the graduations when the toner amount is 500 g, and moves in conformity with the toner remaining amount. When the pointer 42 has come to a portion "a" shown in FIG. 7A, that is, the toner remaining amount has become 50 g, the indication is changed over to a gauge 44 shown in FIG. 7B.

The gauge 44 in FIG. 7B is equally divided from "1K" to "Empty" into five regions, and the size of the gauge 44 is a half of that of the gauge 43 shown in FIG. 7A. This gauge 44 corresponds to the gauge B described with reference to the flow chart of FIG. 6. In the gauge 44 shown in FIG. 7B, a graduation corresponds to a toner amount of 10 g consumed when 200 sheets has been printed at the standard coverage rate. The pointer 42, as in FIG. 7A, moves in conformity with the toner remaining amount, but is adjusted so as to move by a graduation each time 10 g of toner is consumed. When the pointer 42 has moved to a portion "b" shown in FIG. 7B, the toner is depleted.

Thus, when the toner remaining amount has become equal to or less than the predetermined amount, the indication by the gauge 44 changes over so as to indicate the toner remaining amount in greater detail, and the gauge for indicating the toner remaining amount after the changeover is made different from the gauge before the changeover, whereby the toner remaining amount in a state in which the toner amount is small can be accurately communicated to the user and also, it can be made more comprehensible to the user that the toner remaining amount is small. "1K" in FIG. 7B, as described above, shows that the number of remaining printable sheets is about 1,000 sheets at the standard coverage rate.

In the present embodiment, in order that the user may easily recognize the changeover of the indication, the colors of the gauge 43 of FIG. 7A and the gauge 44 of FIG. 7B may be made different from each other.

Also, in the gauge 43 shown in FIG. 7A, the color of the last one graduation may be made different in the sense of warning that the toner remaining amount is small.

Figure 8A:
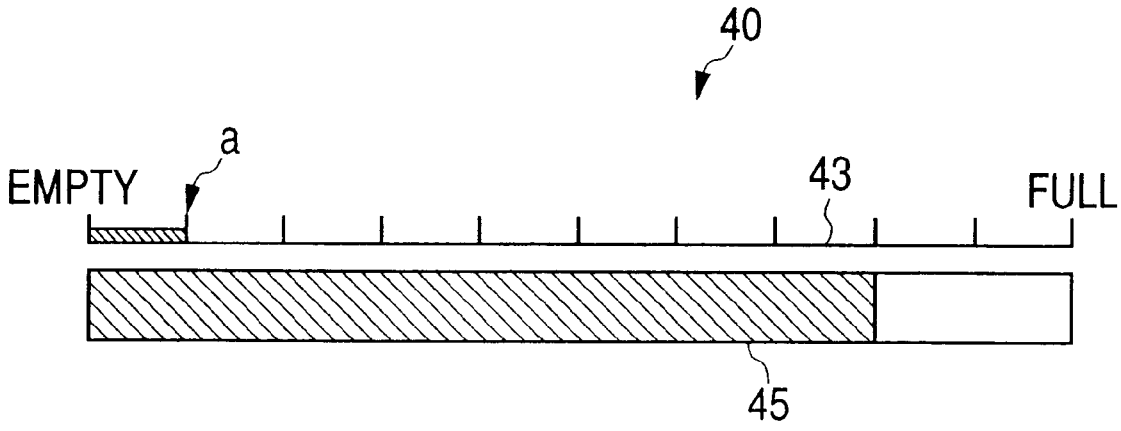
FIGS. 8A and 8B show a modification of the developer amount indication shown in FIGS. 7A and 7B.
Figure 8B:
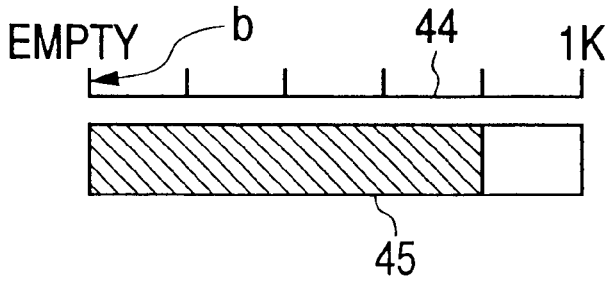

FIGS. 8A and 8B show a modification of the present embodiment in which the toner amount is indicated by a bar 45 instead of the pointer. Again in such a construction, an effect similar to that described above can be obtained.

Again in the present embodiment, as in the first embodiment, the indication of the toner remaining amount may be effected by the indicating means connected to the main body of the image forming apparatus, but in an image forming apparatus connected to a personal computer network, there may be adopted a method of indicating the toner remaining amount on the display screen of each host computer.

Embodiment 3

A third embodiment of the present invention will now be described with reference to FIGS. 9, 10A, 10B, 11A and 11B.

This embodiment is characterized in that when the toner remaining amount has become equal to or less than a predetermined value, the gauge is changed over to a different shape and the graduations are enlarged, and the gauge of the shape before the changeover is also reduced and is indicated at the same time, whereby the toner remaining amount is accurately communicated to the user and generally it is made more comprehensible to the user that the toner remaining amount is small.

The cartridge, the construction of the main body of the apparatus and the block diagram in the present embodiment are similar to those in the first embodiment and therefore need not be described.

Figure 9:
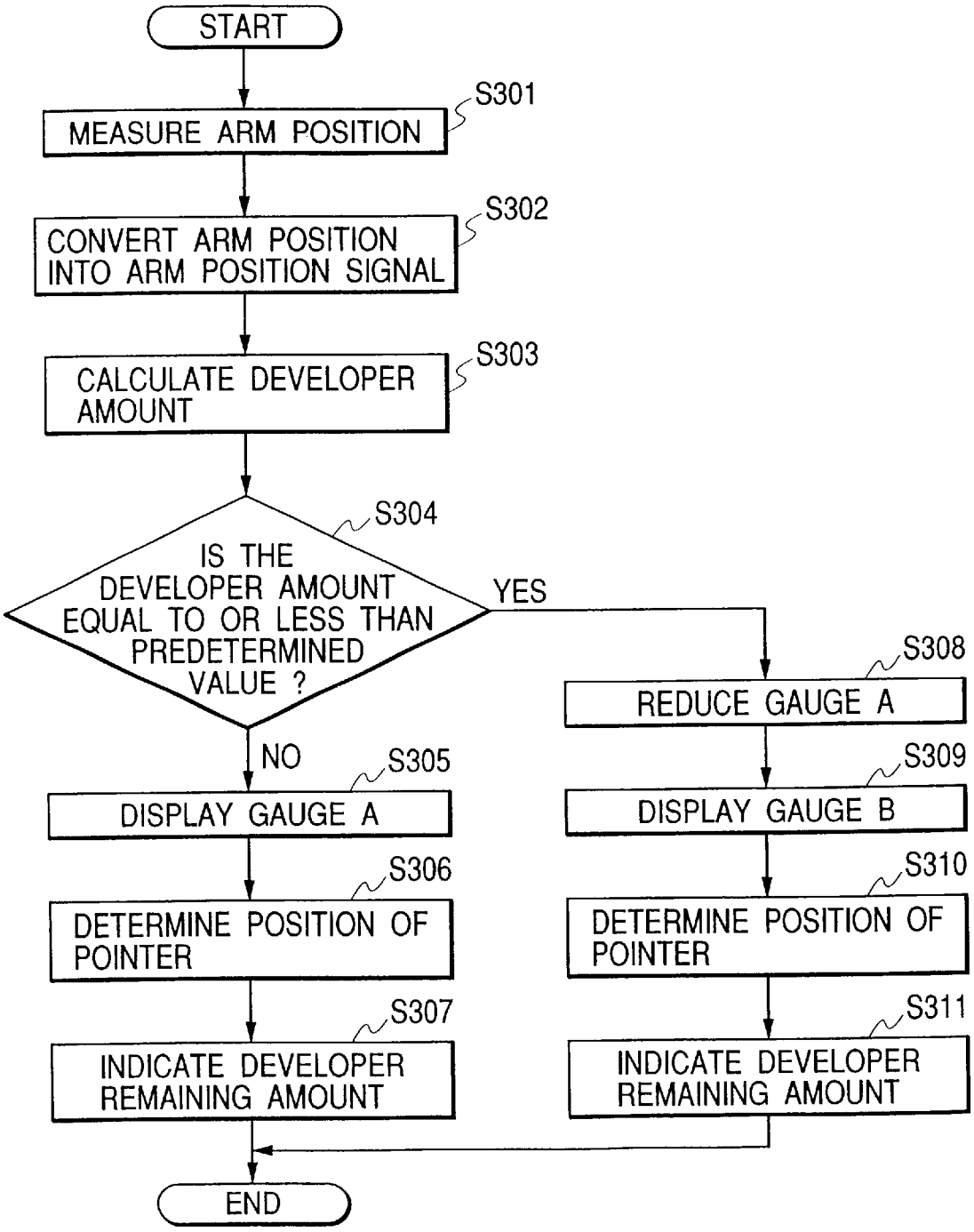
FIG. 9 is a flow chart of still another embodiment of the developer remaining amount indicating operation according to the present invention.

FIG. 9 shows a flow chart of the remaining amount indicating operation in the present embodiment. The operation of the present embodiment will hereinafter be described with reference to FIG. 9.

First, the position of the arm 22 is detected by the developer amount detecting means 20 (S301). Next, the position of the arm 22 is converted into a position signal by the converting means 31 (S302). The position signal is sent to the CPU 32, by which the developer remaining amount is calculated (S303). Whether the found developer amount is greater or smaller than a predetermined value is judged (S304). If it is greater than the predetermined value, the developer still remains in a great amount and therefore, a gauge A wide in the developer remaining amount indication range is selected (S305), and the position of the gauge indicated by a pointer is determined (S306). Thereafter, the developer remaining amount is indicated on the indicating means 33 (S307).

If the developer amount is equal to or less than the predetermined value, it is judged that the exhaustion of the developer is near. First, the gauge A having indicated a wide range is reduced (S308), and a gauge B for indicating a narrow range in detail joins and is displayed (S309), and the position pointed to by the pointers of the two gauge is determined (S310). The result is indicated on the indicating means 33 (S311).

Figure 10A:
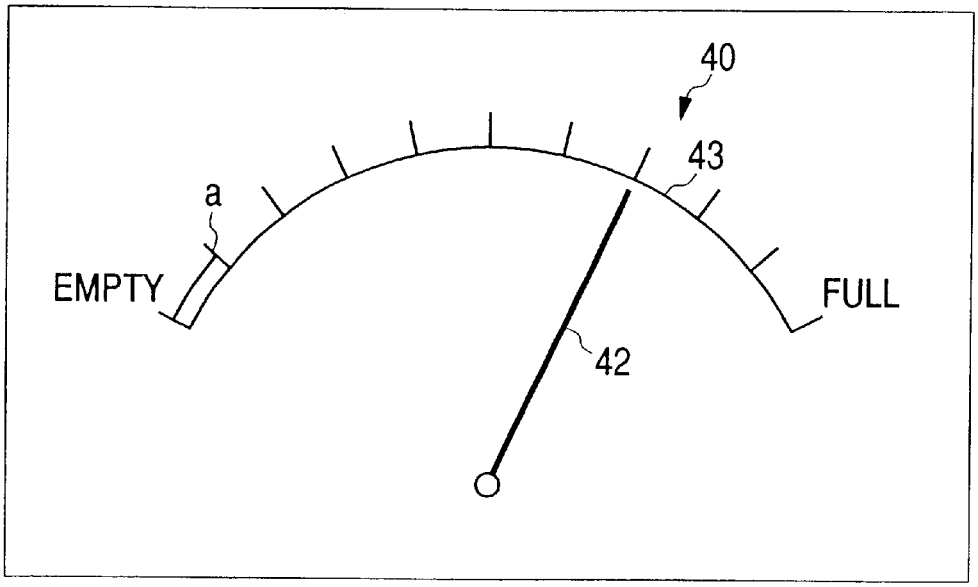
FIGS. 10A and 10B show still a further example of the developer amount indication according to the present invention.
Figure 10B:
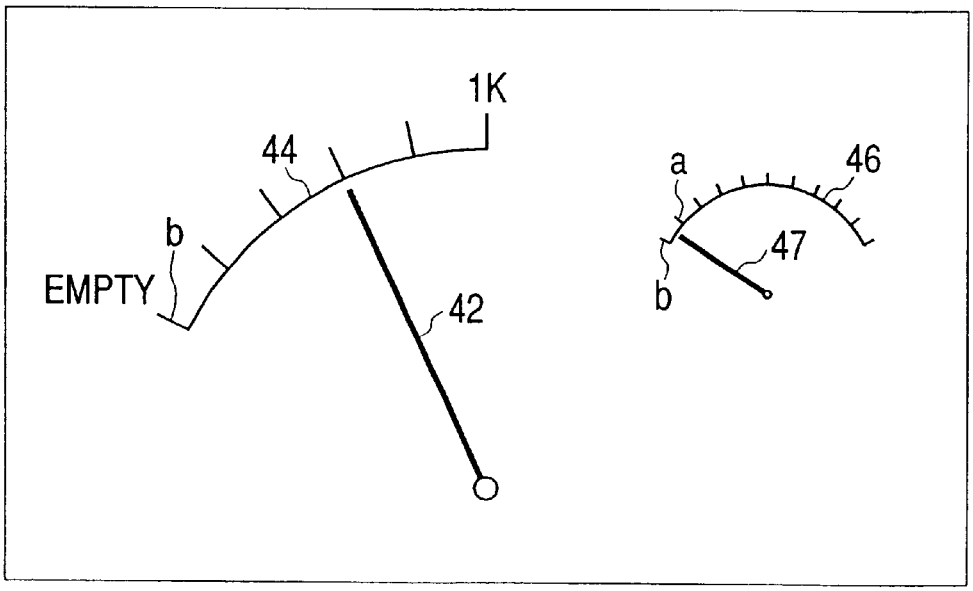

FIGS. 10A and 10B show an example of the developer remaining amount indication 40 on the developer amount indicating means 33 in the present embodiment.

The pointer 42 in FIG. 10A moves in conformity with the surface of the upper portion of the toner in the toner hopper 6. Also, a gauge 43 is equally divided from "Full" to "Empty" into ten regions, and a graduation represents 50 g. This gauge 43 corresponds to the gauge A described with reference to the flow chart of FIG. 9. Also, 50 g is a value equal to the toner amount consumed when 1,000 sheets are printed at the standard coverage rate. The pointer 42 points to the portion of "Full" of the graduations when the toner amount is 500 g, and moves in conformity with the toner remaining amount. When the pointer 42 has come to a position "a" shown in FIG. 10A, that is, the toner remaining amount has become 50 g, changeover is made so as to indicate a gauge 44 and a gauge 46 shown in FIG. 10B at a time.

The left gauge 44 in FIG. 10B is equally divided from "1K" to "Empty" into five regions, and the size of the gauge 44 is a half of that of the gauge 43 shown in FIG. 10A. This gauge 44 corresponds to the gauge B described with reference to the flow chart of FIG. 9. In the gauge 44 shown in FIG. 10B, a graduation corresponds to a toner amount of 10 g consumed when 200 sheets are printed at the standard coverage rate. The pointer 42, as in FIG. 10A, moves in conformity with the toner remaining amount, but is adjusted so as to move by a graduation each time 10 g of toner is consumed. When the pointer 42 has moved to a portion "b" shown in FIG. 10B, the toner is depleted.

Also, the right gauge 46 in FIG. 10B is one obtained by reducing the gauge 43 shown in FIG. 10A, and is similar in division to the gauge 43. The pointer 47 of the gauge 46 moves from the remaining 1K portion "a" to the no-toner portion "b" of the graduations in operative association with the pointer 42 of the left gauge 44.

As described above, when the toner remaining amount has become equal to or less than a predetermined value, the gauge is changed over to a different shape and the graduations are enlarged and the gauge before the changeover is also reduced and indicated at the same time, whereby the toner remaining amount can be accurately communicated to the user and generally it can be made more comprehensible to the user that the toner remaining amount is small.

Figure 11A:
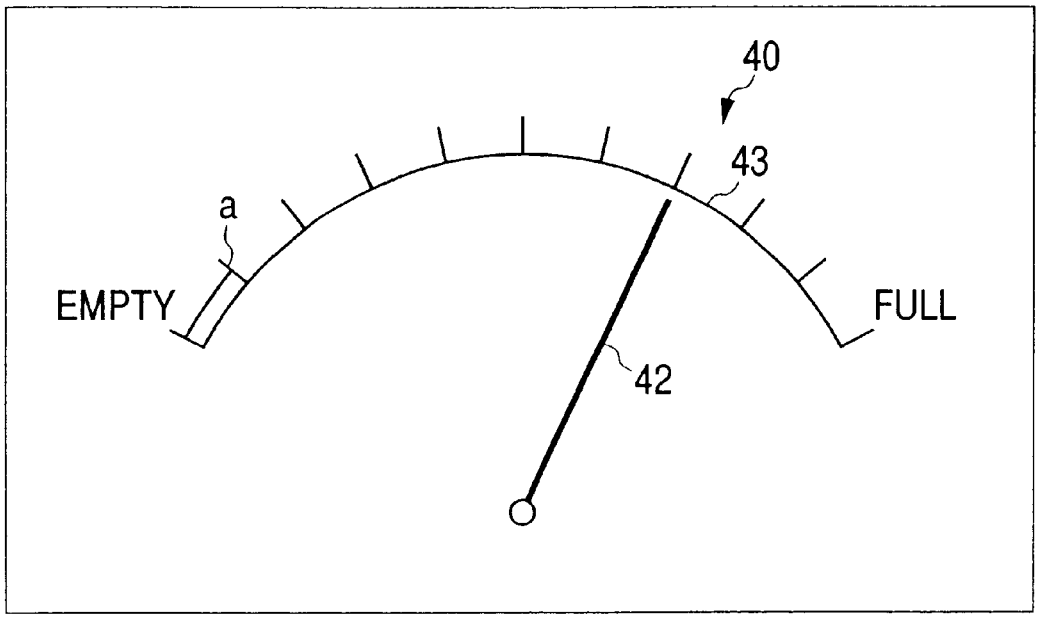
FIGS. 11A and 11B show a modification of the developer amount indication shown in FIGS. 10A and 10B.
Figure 11B:
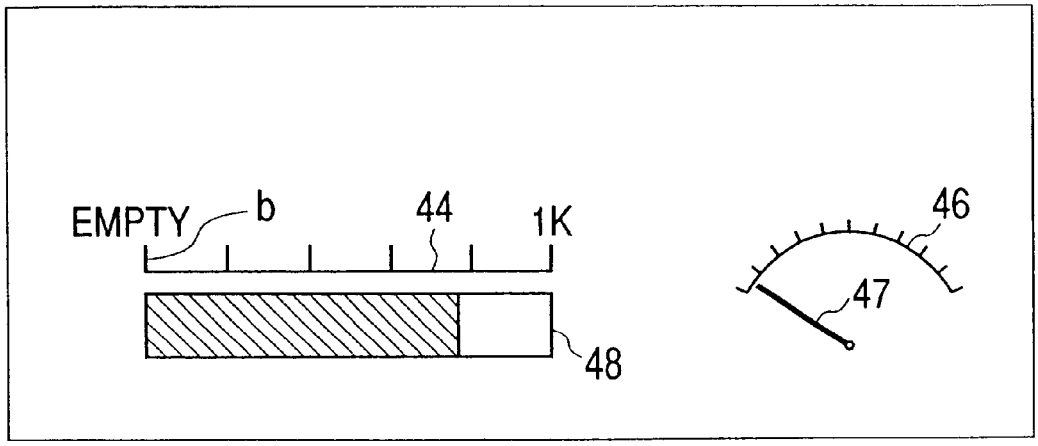
Figure 12:
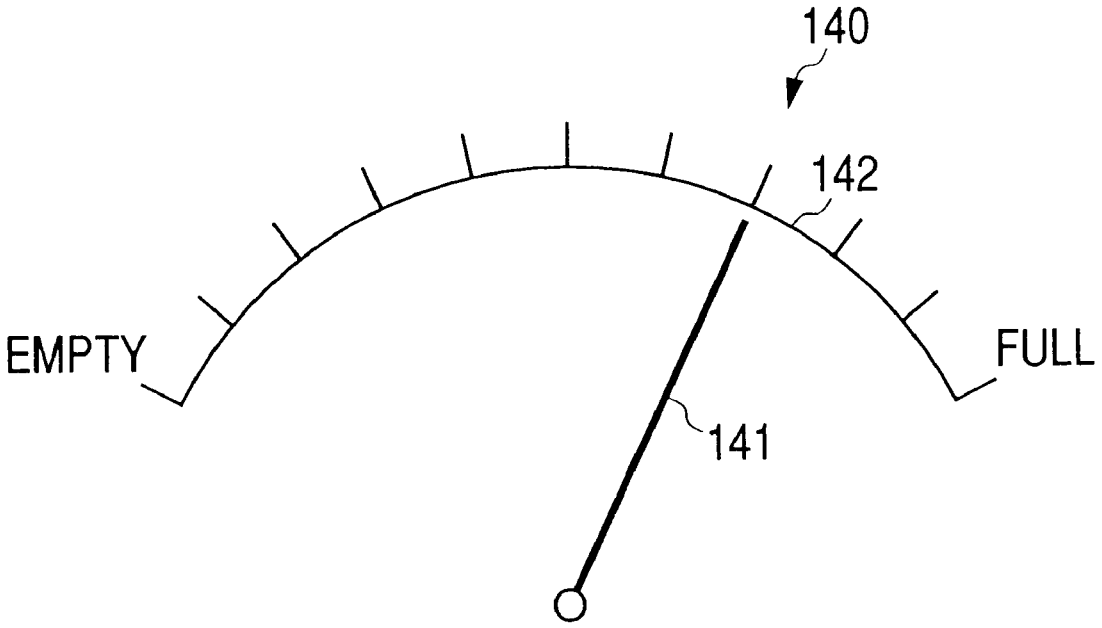
FIG. 12 shows an example of the developer amount indication.

FIGS. 11A and 11B show a modification of the present embodiment, and instead of the pointer 42 of the gauge 44 corresponding to the gauge B after the changeover, a bar 48 indicates the toner amount. Again in such a construction, the effect of the present embodiment can be obtained.

Again in the present embodiment, as in the first embodiment, the indication of the toner remaining amount may be effected by an indicating portion connected to the main body of the image forming apparatus, but in an image forming apparatus connected to a personal computer network, there may be adopted a system in which the toner remaining amount is indicated on the screen of each host computer.

Also, while in the above-described embodiments, a description has been provided with respect to a case where the present invention is applied to an electrophotographic image forming apparatus on which a process cartridge is detachably mounted, the present invention is not restricted thereto. Of course, the present invention can also be applied, for example, to an electrophotographic image forming apparatus which is not of the process cartridge type.

While in the above-described embodiments, description has been made of an example in which "Full" to "Empty" are indicated, the present invention is not restricted thereto. The present invention is also applicable, for example, to a case where the remaining developer of 50% to "Empty" is to be indicated. Also, "Empty" means not only that the remaining toner has become completely null, but also that the developer has decreased to such a degree that an image of a predetermined quality cannot be formed.

As described above, according to the electrophotographic image forming apparatus of the present invention, the developer remaining amount can be indicated comprehensibly to the user.

While the invention has been described with reference to the structure disclosed herein, it is not confined to the details set forth and this application is intended to cover such modifications or changes as may come within the purposes of the improvements or the scope of the following claims.

What is claimed is:

1. An electrophotographic image forming apparatus for forming an image on a recording medium comprising:

(a) an electrophotographic photosensitive member;

(b) electrostatic latent image forming means for forming an electrostatic latent image on said electrophotographic photosensitive member;

(c) developing means for developing the electrostatic latent image formed on said electrophotographic photosensitive member;

(d) developer remaining amount detecting means for successively detecting a remaining amount of developer to be used for a development of said electrostatic latent image by said developing means; and (e) developer remaining amount indicating means for indicating the remaining amount of developer detected by said developer remaining amount detecting means;

said developer remaining amount indicating means indicating the remaining amount of developer comprising a gauge having graduations that are changed in conformity with the remaining amount of developer.

2. An electrophotographic image forming apparatus on which a process cartridge is detachably mountable for forming an image on a recording medium, said electrophotographic image forming apparatus comprising:

(a) mounting means for detachably mounting the process cartridge, said process cartridge having an electrophotographic photosensitive member and developing means for developing an electrostatic latent image formed on said electrophotographic photosensitive member;

(b) developer remaining amount detecting means for successively detecting a remaining amount of developer to be used for a development of said electrostatic latent image by said developing means; and (c) developer remaining amount indicating means for indicating the remaining amount of developer detected by said developer remaining amount detecting means;

said developer remaining amount indicating means indicating the remaining amount of developer comprising a gauge having graduations that are changed in conformity with the remaining amount of developer.

3. An electrophotographic image forming apparatus according to claim 1 or 2, wherein the width of the graduations of the gauge is enlarged and changed in conformity with a decrease in said developer remaining amount.

4. An electrophotographic image forming apparatus according to claim 1 or 2, wherein when said developer remaining amount has become equal to or less than a predetermined value, width of the graduations of the gauge from said predetermined value to a value indicating that no developer exists is enlarged.

5. An electrophotographic image forming apparatus according to claim 1 or 2, wherein said developer remaining amount indicating means indicates the remaining amount of developer on a main body of the electrophotographic image forming apparatus or on a host computer connected to the main body of the electrophotographic image forming apparatus.

6. An electrophotographic image forming apparatus for forming an image on a recording medium comprising:

(a) an electrophotographic photosensitive member;

(b) electrostatic latent image forming means for forming an electrostatic latent image on said electrophotographic photosensitive member;

(c) developing means for developing the electrostatic latent image formed on said electrophotographic photosensitive member;

(d) developer remaining amount detecting means for successively detecting a remaining amount of developer to be used for a development of said electrostatic latent image by said developing means; and (e) changeover means for increasing the width of graduations for indicating the remaining amount of developer when said developer remaining amount detecting means detects that the remaining amount of developer has become smaller than a predetermined remaining amount.

7. An electrophotographic image forming apparatus on which a process cartridge is detachably mountable for forming an image on a recording medium, said electrophotographic image forming apparatus comprising:

(a) mounting means for detachably mounting the process cartridge, said process cartridge having an electrophotographic photosensitive member and developing means for developing an electrostatic latent image formed on said electrophotographic photosensitive member;

(b) developer remaining amount detecting means for successively detecting a remaining amount of developer to be used for a development of said electrostatic latent image by said developing means; and (c) changeover means for increasing the width of graduations for indicating the remaining amount of developer when said developer remaining amount detecting means detects that the remaining amount of developer has become smaller than a predetermined remaining amount.

8. An electrophotographic image forming apparatus according to claim 6 or 7, wherein indication of the remaining amount of developer is displayed on a main body of said image forming apparatus or a display screen of a host computer electrically connected to the main body of said image forming apparatus.

9. An electrophotographic image forming apparatus according to claim 7, wherein said process cartridge further has a charging member for charging said electrophotographic photosensitive member.

10. An electrophotographic image forming apparatus according to claim 6 or 7, wherein indication of the remaining amount of developer comprises indicating the graduations by a pointer.

11. An electrophotographic image forming apparatus according to claim 6 or 7, wherein indication of the remaining amount of developer comprises indicating the graduations by a bar.

* * * * *

UNITED STATES PATENT AND TRADEMARK OFFICE

CERTIFICATE OF CORRECTION

PATENT NO. : 6,408,143 B2
DATED : June 18, 2002
INVENTOR(S) : Kazushige Sakurai et al.

It is certified that error appears in the above-identified patent and that said Letters Patent is hereby corrected as shown below:

Column 1,
Line 39, “users” should read -- user --.

Column 3,
Line 20, “restricted” should read -- restricted by --.

Signed and Sealed this

Fourth Day of March, 2003

JAMES E. ROGAN
*Director of the United States Patent and Trademark Office*